US009024221B2

(12) United States Patent
Lohr

(10) Patent No.: US 9,024,221 B2
(45) Date of Patent: May 5, 2015

(54) ELECTRICAL SWITCH DEVICE FOR A MACHINE TOOL

(71) Applicant: Guenter Lohr, Leinfelden-Echterdingen (DE)

(72) Inventor: Guenter Lohr, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 158 days.

(21) Appl. No.: 13/760,371

(22) Filed: Feb. 6, 2013

(65) Prior Publication Data

US 2013/0199913 A1 Aug. 8, 2013

(30) Foreign Application Priority Data

Feb. 6, 2012 (DE) ..... 10 2012 201 672

(51) Int. Cl.

| | |
|---|---|
| ***H01H 1/00*** | (2006.01) |
| ***H01H 1/24*** | (2006.01) |
| ***B25F 5/00*** | (2006.01) |
| ***H01H 9/06*** | (2006.01) |

(52) U.S. Cl.

CPC .. *H01H 1/24* (2013.01); *B25F 5/00* (2013.01); *H01H 9/06* (2013.01)

(58) Field of Classification Search

USPC ..... 200/502, 505, 509–510, 329, 341, 16 C, 200/17 R; 439/188

See application file for complete search history.

(56) References Cited

U.S. PATENT DOCUMENTS

| | | | | |
|---|---|---|---|---|
| 3,801,766 | A * | 4/1974 | Morrison, Jr. | 200/553 |
| 4,092,581 | A | 5/1978 | Ascoli | |
| 7,134,364 | B2 | 11/2006 | Kageler et al. | |
| 8,198,560 | B2 * | 6/2012 | Kimata et al. | 200/318.1 |
| 2011/0194710 | A1 * | 8/2011 | Prest et al. | 381/122 |

FOREIGN PATENT DOCUMENTS

| | | |
|---|---|---|
| DE | 103 45 136 | 4/2005 |
| WO | WO 2008/107231 | 9/2008 |

* cited by examiner

*Primary Examiner* — Edwin A. Leon

(74) *Attorney, Agent, or Firm* — Kenyon & Kenyon LLP

(57) ABSTRACT

An electric switch device for a machine tool has a switch-side contact element, that is held movably and is in contact, in a contact position, with a mating contact element so as to close a circuit. The switch-side contact element is a switching spring, which is acted upon by its internal stress to move into the out-of-contact position.

6 Claims, 2 Drawing Sheets

ELECTRICAL SWITCH DEVICE FOR A MACHINE TOOL

CROSS REFERENCE

The present application claims the benefit under 35 U.S.C. §119 of German Patent Application No. DE 102012201672.4 filed on Feb. 6, 2012, which is expressly incorporated herein by reference in its entirety.

FIELD

The present invention relates to an electrical switch device for a machine.

BACKGROUND INFORMATION

German Patent Application No. DE 103 45 136 A1 describes a battery-driven screwdriver which has an electric drive motor that is switched on and off via a switch device. The switch device includes a switching element which is held on the housing of the battery-operated screwdriver in an adjustable manner and is able to be operated by the user. Electrical contact elements are situated on the switching element which, when the switching element is operated, touch mating contacts on a mounting plate and thereby close a circuit for starting the electric drive motor.

In the case of the contact elements and the mating contact elements one should take care that the electric circuit is able to be safely closed when the switching element is operated, even over a long operating time. This assumes a safe fastening of the contact elements and the mating contact elements on the switching element or the mounting plate, which is produced, for instance, via soldering locations. However, the connections may not detach while being acted upon with force during the operation of the switching element.

SUMMARY

An object of the present invention is to provide a robust electrical switch device for a machine tool using simple constructive measures.

An example electrical switch device in accordance with the present invention is used to switch on and off the drive motor for a machine tool, especially an hand-held machine tool. The drive motor is preferably an electrical drive motor. The hand-held machine tool is a battery-driven screwdriver or a battery driven drill, for example.

The example electrical switch device includes a switch-side contact element, which is situated on a switching element and executes a relative motion with respect to the housing of the machine tool, in common with the switching element, during operation by the operating person. For this purpose, the switching element, inclusive of the switch-side contact element, is held advantageously in a translatorily adjustable manner on the housing of the machine tool. Basically, however, rotatory switching motions or combined translatory rotatory switching motions may come into consideration.

During operation by the operating person, the contact element is to be put in contact with a mating contact element, so as to close an electric circuit for starting the drive motor. The mating element is located on a mounting plate which is built into the housing of the machine tool.

In order to ensure that, during an operation of the switching element and the closing of the circuit, the forces occurring in this instance do not lead to any damage of the components, the contact element, which is actuated by the switching element, is a switching spring which, because of its internal stress, is acted upon to move to the out-of-contact position in which no contact exists with the mating contact element. This example embodiment has the advantage that the spring element, which acts with force upon the switching element in the direction of the out-of-contact position, and the contact element are combined in a single, common component, namely the switching spring, based on the elastic spring properties, during operation of the switching element, the forces acting upon the components of the switch device being limited. Because of that, even over a long operating time period, the desired reliability is ensured.

According to one advantageous example embodiment, the switching spring is held on the mounting plate. On the part of the switch element, the switching spring may either be fixedly connected to the switch element, or, according to an alternative embodiment, may be pressed together without connection, only during operation by the operating person of the switch element against the spring force.

According to an additional embodiment, it is, however, also possible that the switching spring is held, not on the mounting plate, but on the switching element and during an operation of the switching element, gets in contact with at least one contact element on the mounting plate. Moreover, it is possible to position the switching spring on the housing, without a fixed connection to the mounting plate or to the switching element.

To the extent that, according to one preferred embodiment, the switching spring is held on the mounting plate, the soldering of a soldering section of the switching spring on the mounting plate comes into consideration as a type of connection. Hereby an electrical contact of the switching spring to the respective section of the mounting plate is assured, with the operation of the switching element and the contact of the switching spring to the mating contact element on the mounting plate, the circuit for starting the drive motor being closed. The soldering section of the switching spring is in electrical contact to a first mating contact element on the mounting plate. To close the circuit, in response to the operation of the switching element, an additional section of the switching spring touches a second mating contact element on the mounting plate, so that the current flows from the first mating contact element, through the switching spring, to the second mating contact element.

Instead of the soldering connection, additional connecting measures of the switching spring to the mounting plate come into consideration, particularly mechanical types of connection, such as clamping, or the like.

In the case of the action of force in the direction of the contact position, a supporting section of the switching spring supports itself expediently on the mounting plate. This supporting section may be the soldering section, if necessary, via which the switching spring is soldered to the mounting plate. In order to ensure that forces acting upon the switching spring do not stress the soldering connection by tension, the switching spring expediently, in addition to the first supporting section, has an additional second supporting section which, in the case of force tension, is also supported on the mounting plate, but preferably on the opposite side of the mounting plate, in order to achieve a lever action by which the soldering section is pressed against the mounting plate. In this case, it may be expedient to guide the switching spring through a recess in the mounting plate, so that the supporting sections are located at opposite side surfaces of the mounting plate. Basically, however, the encompassing of the mounting plate by the switching spring is also possible.

The second supporting section that lies opposite to the first supporting section, which may be a soldering section, is developed, for example, as a supporting bulge which, in the case of a force acting upon the switching spring by the switching element, is supported on the mounting plate using only a small contact surface. If necessary, the supporting bulge lies against the side surface of the mounting plate only in the case of the action of a force, but not in the initial state, when the switching element is not being operated. An embodiment is, however, also possible in which the supporting bulge lies against the side surface of the mounting plate, both in the initial state and in response to an operation of the switching spring via the switch element.

According to one additional expedient embodiment, the switching spring is provided with a contact section which is associated with the mating contact element on the mounting plate, and touches the mating contact element during an actuation of the switch element, as well as a fastening section which is connected in an elastically springy manner to the contact section and is operated by the switch element. It is ensured thereby that the operation via the switch element is transmitted in an elastically springy manner from the operating section to the contact section, whereby force peaks are avoided, particularly in response to the touching of the contact section and the mating contact section. It may be expedient that the operating section of the switching spring takes up at least approximately a U-shape with the contact section in the unstressed state, so that the corresponding legs of the operating section and the contact section in the unstressed state of the spring lie at least approximately parallel to each other or are at only a relatively small angle to each other. In this way, a good spring action may be assured.

Further advantages and expedient implementations may be gathered from the description of the figures themselves.

DETAILED DESCRIPTION OF EXAMPLE EMBODIMENTS

Figure 1:
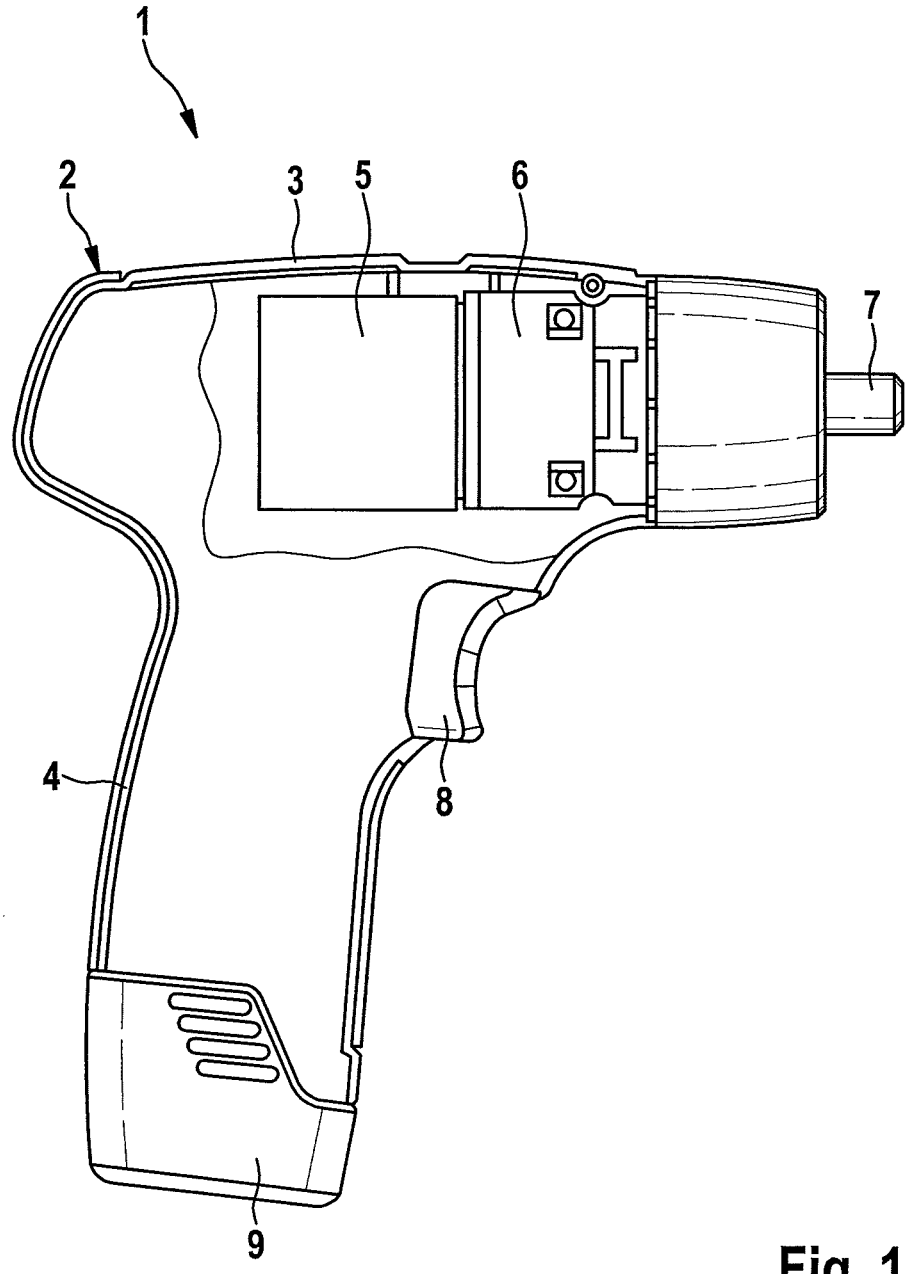
FIG. 1 shows an electric hand-held machine tool executed as a battery-operated screwdriver or drill, having a switch element executed as a push-button on the housing to actuate an electric drive motor.

The battery-operated screwdriver or drill 1 has a housing 2 having a motor housing 3 and a handle housing 4. An electric drive motor 5 is situated in motor housing 3, whose motor shaft drives a rotatingly supported tool mounting 7 via a gearing 6 for the accommodation of a tool.

To start electric drive motor 5, a switch element 8, that is designed like a push-button and situated displaceably on housing 2 is actuated by the operating person. Switch element 8 is a component of a switch device for closing a circuit so as to put the drive motor in gear.

In the lower region of handle housing 4, a battery pack 9, via which the electric drive motor is supplied with power, is fastened detachably to the housing.

Figure 2:
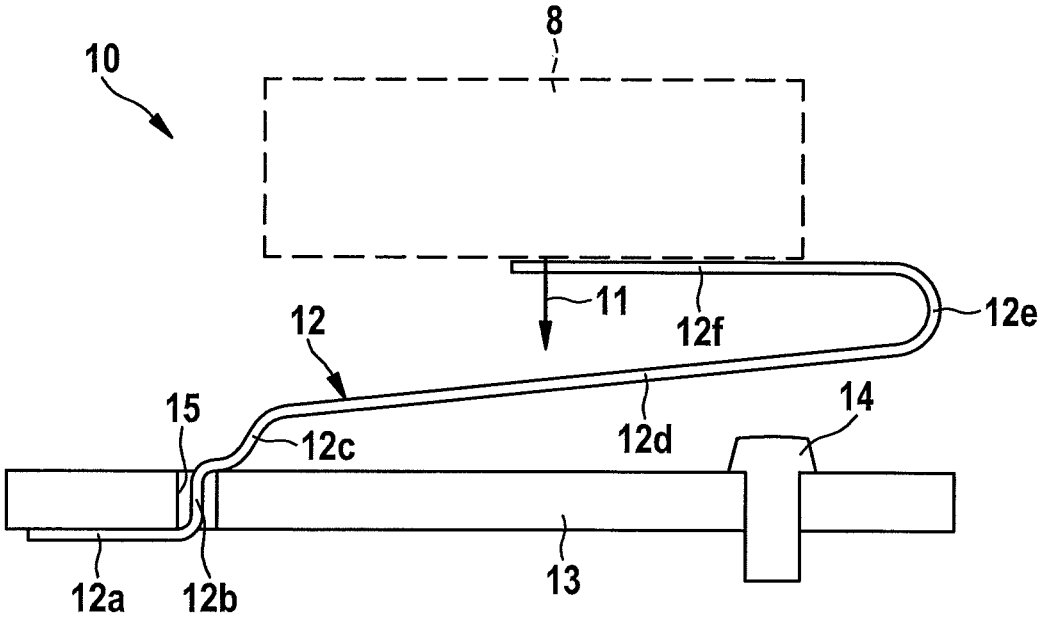
FIG. 2 shows an electric switch device having a switching spring held on a mounting plate, which is able to be shifted by the switch element to a contact position with a mating contact element on the mounting plate.

FIG. 2 shows switch device 10 for switching on and off the electric drive motor. Besides switch element 8, a switching spring 12 is a part of switch device 10, as well as a mounting plate 13, on which a mating contact element 14 is situated which is contacted by electrically conducting switching spring 12, in response to the actuation of switch element 8. Switching spring 12 is held on mounting plate 13 and has an end-positioned soldering and supporting section 12*a*, which is soldered to a side surface of mounting plate 13, and is in electrical contact with a mating contact element on the mounting plate. Furthermore, switching spring 12 is provided with a connecting section 12*b*, which is next to soldering section 12*a*, and which is guided all the way through a recess 15 in the mounting plate. On the opposite side of mounting plate 13, connecting section 12*b* goes over into a further supporting section 12*c*, which is developed as a supporting bulge, which lies, using only a small contact surface, on mounting plate 13 on the side opposite to soldering section 12*a*.

Further on, next to supporting bulge 12*c* there is a contact section 12*d* as well as an operating section 12*f*, which is connected to contact section 12*d* via an arch-shaped connecting section 12*e*; contact section 12*d*, connecting section 12*e* and actuating section 12*f* for at least approximately a U-shape in the unstressed state of switching spring 12.

When switch element 8 is moved in arrow direction 11 onto mounting plate 13, switch element 8 also moves actuating section 12*f* of switching spring 12, the moving motion also has an effect via connecting section 12*e* on contact section 12*d*, which is also moved in the direction onto mounting plate 13 up until contact with mating contact element 14. As soon as contact is made with mating contact element 14, the circuit is closed.

In response to the movement of switching spring 12 in the direction of arrow 11 counter to the internal stress of the switching spring, soldering section 12*a* is pressed against the side surface of mounting plate 13, so that the soldering connection is stressed only to pressure, but not to tension. At the same time, supporting bulge 12*c* is supported on the opposite side surface of the mounting plate, whereupon, in response to an action upon switching spring 12 via switch element 8, a part of the forces is already being introduced via switching bulge 12 onto mounting plate 13.

What is claimed is:

1. A hand-held machine tool, comprising:

an electric drive motor;

a tool mounting that is driven by the electric drive motor;

an electrical switch device, the switch device including a switch-side contact element which is held in a movable manner and is in a contact position in contact with a mating contact element situated on a mounting plate for closing a circuit;

a user-operable switch element that is operable by a user and that is configured to operate the electrical switch device, wherein the switch-side contact element is a switching spring, which, because of an internal stress of the switching spring, is acted upon to be in an out-of-contact position, wherein a supporting section of the switching spring is configured so that it is supported on the mounting plate in response to an application of force on the contact position, wherein the switching spring has a first supporting section and a second supporting section, the first supporting section and the second supporting section being situated on respective opposite sides of the mounting plate, wherein the switching spring has a soldering section which is soldered to the mounting plate and wherein one of the first supporting section or the second supporting section is formed by the soldering section, wherein the switching spring includes a supporting section having a supporting bulge, which in response to the application of force onto the switching spring is pressed against the mounting plate in the direction of the contact position, and wherein the supporting section having the supporting bulge is situated on the mounting plate on a side opposite to the soldering section.

2. The hand-held machine tool as recited in claim 1, wherein the switching spring is held on the mounting plate.

3. The hand-held machine tool as recited in claim 2, wherein the switching spring has a soldering section which is soldered to the mounting plate.

4. The hand-held machine tool as recited in claim 1, wherein the switching spring extends all the way through a recess in the mounting plate.

5. The hand-held machine tool as recited in claim 1, wherein the switching spring has a contact section, which is associated with the mating contact element, and an actuating section which is connected in an elastically springy manner to the contact section.

6. The hand-held machine tool as recited in claim 5, wherein the actuating section is configured so that in the unstressed state of the switching spring, the actuating section forms a U-shape with the contact section.

* * * * *